US007045943B2

(12) United States Patent
Hwang

(10) Patent No.: US 7,045,943 B2
(45) Date of Patent: May 16, 2006

(54) ELECTRON GUN FOR CATHODE RAY TUBE HAVING THIRD TO FIFTH ELECTRODES WITH DIFFERENT SIZED ELECTRON BEAM THROUGH HOLES

(75) Inventor: Dae Sik Hwang, Kumi-shi (KR)

(73) Assignee: LG.Philips Displays Co., Ltd., Kimi-Shi (KR)

( * ) Notice: Subject to any disclaimer, the term of this patent is extended or adjusted under 35 U.S.C. 154(b) by 1 day.

(21) Appl. No.: 10/162,874

(22) Filed: Jun. 6, 2002

(65) Prior Publication Data

US 2003/0020391 A1 Jan. 30, 2003

(30) Foreign Application Priority Data

Jul. 25, 2001 (KR) ..... P2001-44873
Apr. 29, 2002 (KR) ..... P2002-23428

(51) Int. Cl.
*H01J 29/50* (2006.01)

(52) U.S. Cl. ..... 313/409; 313/414; 313/441

(58) Field of Classification Search ..... 313/409, 313/411, 414, 441, 452, 453
See application file for complete search history.

(56) References Cited

U.S. PATENT DOCUMENTS 4,169,239 A 9/1979 Ehata et al. ..... 315/16
4,426,583 A * 1/1984 Chang et al. ..... 250/398
4,540,916 A * 9/1985 Maruyama et al. ..... 315/16
4,866,335 A * 9/1989 Cho ..... 313/412
5,015,911 A * 5/1991 Cho ..... 313/414
5,039,906 A 8/1991 Park ..... 313/414
5,281,892 A * 1/1994 Kweon et al. ..... 313/414
5,386,178 A * 1/1995 Son et al. ..... 315/15
5,606,216 A * 2/1997 Uchida et al. ..... 313/412
5,710,481 A * 1/1998 Park et al. ..... 313/414
5,994,827 A 11/1999 Kim et al. ..... 313/414
6,570,349 B1 * 5/2003 Kimiya et al. ..... 315/382

FOREIGN PATENT DOCUMENTS

CN 111809 A 11/1995
CN 1111811 A 11/1995
GB 2115605 A 9/1983
JP 7-14521 A 1/1995
JP 2001155657 A 6/2001

* cited by examiner

*Primary Examiner*—Joseph Williams
*Assistant Examiner*—Kevin Quarterman
(74) *Attorney, Agent, or Firm*—Birch, Stewart, Kolasch & Birch, LLP

(57) ABSTRACT

An electron gun for a cathode ray tube is disclosed, which has a simple structure and can prevent the spot on a screen from being degraded. In the electron gun for a cathode ray tube including a cathode that emits electron beams, a first electrode that controls the electron beams emitted from the cathode, a second electrode that accelerates the electron beams emitted from the first electrode, and third to fifth electrodes sequentially arranged in a screen direction to act as pre-focus lenses, the electron gun is characterized in that the third to fifth electrodes have different sized electron beam through holes.

16 Claims, 4 Drawing Sheets

(a)

No aberration (b)

aberration

ELECTRON GUN FOR CATHODE RAY TUBE HAVING THIRD TO FIFTH ELECTRODES WITH DIFFERENT SIZED ELECTRON BEAM THROUGH HOLES

This application claims the benefit of the Korean Application No. P2001-44873 filed on Jul. 25, 2001 and the Korean Application No. P2002-23428 filed on Apr. 29, 2002, which is hereby incorporated by reference.

BACKGROUND OF THE INVENTION

1. Field of the Invention

The present invention relates to a cathode ray tube, and more particularly, to an electron gun for a cathode ray tube that can reduce a change in the size of a spot due to a change of a focus voltage and a change of current.

2. Discussion of the Related Art

Generally, a cathode ray tube includes an in-line electron gun that emits three electron beams, a deflection yoke that deflects the electron beams in a predetermined place of a screen, a shadow mask that selects the electron beams, and a screen that reproduces a picture image by colliding with the electron beams.

According to the Japanese Patent Laid-Open No. 60-51775, a typical electron beam spot becomes great if beam current increases. Therefore, to obtain a fine picture image, the beam current should be within the smaller range if possible. However, since a cathode ray tube that requires high current has a great change of current, a uni-bi potential lens structure having an improved pre-focus area in a bi potential main lens structure has been employed to reduce the spot size on the screen.

A related art electron gun for a cathode ray tube will be described with reference to FIG. 1.

Referring to FIG. 1, the related art electron gun includes a cathode K that emits three electron beams of R, G, and B, a first electrode 1 that controls the electron beams emitted from the cathode K, a second electrode 2 that accelerates a thermal electron emitted from the first electrode 1, third, fourth and fifth electrodes 3, 4, and 5 that focus the electron beams, and a sixth electrode 6 that acts as an anode.

The operation of the aforementioned related art electron gun will now be described.

If a heater provided inside the cathode K heats the cathode K, the electron beams are emitted. The emitted electron beams are controlled by the first electrode 1 that acts as a control electrode. Also, the emitted electron beams are accelerated by the second electrode 2 and focused by the third to sixth electrodes 3, 4, 5, and 6.

Meanwhile, if high current is generated from the electron gun, the current density of crossover does not increase by an increased value of the beam current due to the space charge repulsion. The current density is uniformly distributed without forming a Gaussian distribution, thereby degrading the crossover. If the crossover is degraded, the spot on the screen is degraded accordingly.

To prevent the crossover from being degraded, it is necessary to reduce the potential of the crossover, thereby reducing the space charge repulsion. To increase a voltage of the crossover, the third electrode 3 moves to the second electrode 2. Thus, the potential of the crossover increases while the space charge repulsion decreases.

However, in this case, an emitting angle $\alpha$ increases and thus the size Db of the electron beam in a main lens increases. As shown in FIGS. 7 and 8, if the size Db of the electron beam in the main lens increases, spherical aberration increases. In this case, a problem arises in that the size of the spot on the screen increases.

To solve such a problem, it is necessary to reduce the emitting angle after the crossover passes. Since the crossover moves over the second electrode 2 under the high current, it is difficult to reduce the emitting angle by means of the third to fifth electrodes 3, 4, and 5.

To reduce the emitting angle $\alpha$ after the crossover passes, another pre-focus lens may be provided between the pre-focus lens by the second and third electrodes 2 and 3 and the main lens.

As shown in FIG. 1, the pre-focus lens is formed in a uni-potential lens structure by dividing a focus electrode into the third, fourth, and fifth electrodes 3, 4, and 5 and applying the same voltage to the third and fifth electrodes 3 and 5. At this time, an electron beam through hole 41 of the fourth electrode 4 has the same size as that of an electron beam through hole 51 of the fifth electrode 5. The electron beam through hole 51 of the fifth electrode 5 is formed in a direction of the fourth electrode. The electron beam through hole 41 of the fourth electrode is greater than an electron beam through hole 31 of the third electrode 3.

In this case, the emitting angle of the electron beams entered into the main lens decreases. This decreases the size Db of the electron beam in the main lens. If the size Db of the electron beam in the main lens decreases, the spherical aberration decreases. As a result, the size of the spot on the screen decreases.

However, the aforementioned related art electron gun has several problems.

As described above, in the related art electron gun, the fourth electrode is formed in a plate shape in the pre-focus lens at the front of the main lens so that the emitting angle of the electron beams is adjusted. At this time, the fourth electrode is adjacent to the third electrode while the fifth electrode is adjacent to the fourth electrode. In forming the pre-focus lens, the electron beam through hole of the fourth electrode has the same size as that of the fifth electrode. In this case, design factors that can adjust the emitting angle are limited to each thickness of the third, fourth, and fifth electrodes, the distance d1 between the third electrode and the fourth electrode, the distance d2 between the fourth electrode and the fifth electrode, the size of the electron beam through hole of the third electrode, the size of the electron beam through hole of the fourth electrode, and the size of the electron beam through hole of the fifth electrode. As a result, to additionally adjust the emitting angle, supplementary electrodes are required among the second electrode, the third electrode, and the fourth electrode. This causes a complicated structure.

SUMMARY OF THE INVENTION

Accordingly, the present invention is directed to an electron gun for a cathode ray tube that substantially obviates one or more problems due to limitations and disadvantages of the related art.

An object of the present invention is to provide an electron gun for a cathode ray tube that has a simple structure and can prevent the spot on a screen from being degraded.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, in an electron gun for a cathode ray tube including a cathode that emits electron beams, a first electrode that controls the electron beams emitted from the cathode, a second electrode that accelerates the electron beams emitted from the first electrode, and third to fifth electrodes sequentially arranged in a screen direction to act as pre-focus lenses, the electron gun is characterized in that the third to fifth electrodes have different sized electron beam through holes.

Preferably, each electron beam through hole of the third and fourth electrodes is smaller than the electron beam through hole of the fifth electrode.

Preferably, the electron beam through hole of the third electrode is smaller than that of the fourth electrode.

In another aspect of the present invention, the electron beam through hole of the fourth electrode has a rectangular shape and its vertical length is different from its horizontal length.

In another aspect of the present invention, the third electrode has a first through hole opposite to the second electrode and a second through hole opposite to the fourth electrode.

Preferably, the size of the first through hole is different from that of the second through hole. More preferably, the size of the first through hole is smaller than that of the second through hole.

Therefore, in the present invention, it is possible to effectively prevent the spot from being degraded even if no separate supplementary electrode is provided.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
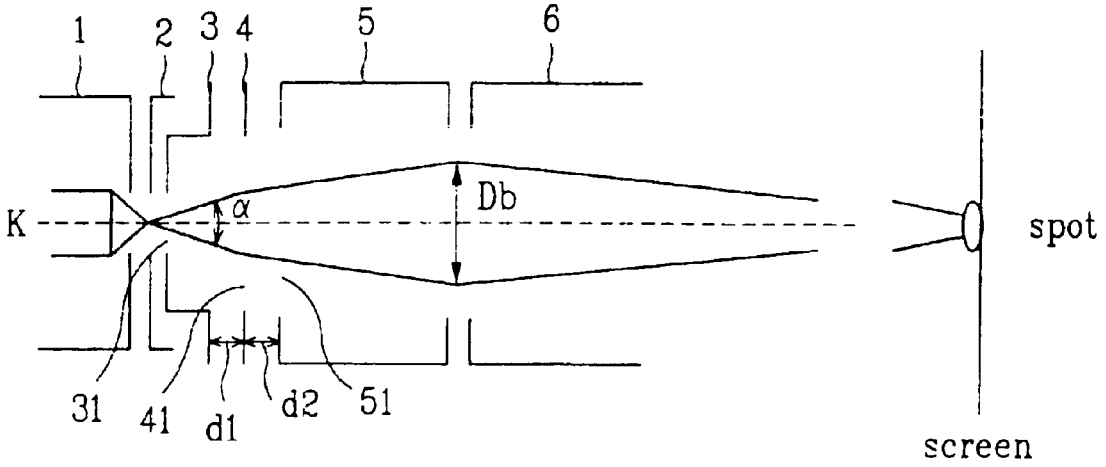
FIG. 1 Related Art
FIG. 1 is a schematic view illustrating a related art electron gun for a cathode ray tube.
Figure 2:
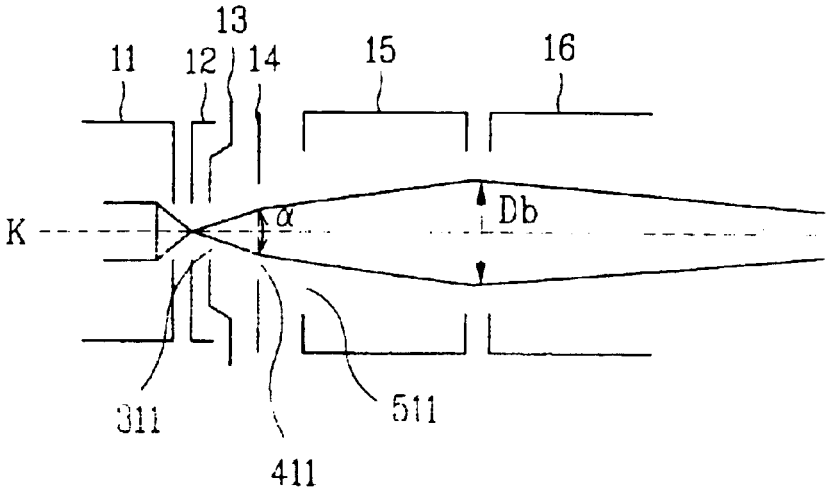
FIG. 2 is a schematic view illustrating an electron gun for a cathode ray tube according to the first embodiment of the present invention.

An electron gun for a cathode ray tube according to the first embodiment of the present invention will be described with reference to FIG. 2.

Similarly to the related art electron gun, an electron gun for a cathode ray tube according to the first embodiment of the present invention includes a cathode K that emits electron beams, a first electrode 11 that controls the electron beams emitted from the cathode K, a second electrode 12 that accelerates the electron beams, a pre-focus lens of third, fourth and fifth electrodes 13, 14 and 15 that control an emitting angle of the electron beams, and fifth and sixth electrodes 15 and 16 that constitute a main lens part.

In the first embodiment according to the present invention, the third electrode 13 is arranged to oppose and be adjacent to the fourth electrode 14. The fourth electrode 14 is arranged to oppose and be adjacent to the fifth electrode 15. The third electrode 13, the fourth electrode 14, and the fifth electrode 15 have different electron beam through holes 311, 411 and 511, respectively.

For example, the electron beam through hole 411 of the fourth electrode 14 may be greater than the electron beam through hole 311 of the third electrode 13. The electron beam through hole 511 of the fifth electrode 15 may be greater than the electron beam through hole 411 of the fourth electrode 14.

Alternatively, the electron beam through hole 311 of the third electrode 13 and the electron beam through hole 411 of the fourth electrode 14 may be smaller than the electron beam through hole 511 of the fifth electrode 15.

In this case, an emitting angle $\alpha$ of the electron beam and the size of the electron beam in the main lens part may easily be varied.

The principle of the present invention will be described in more detail with reference to FIGS. 3 and 4.

Figure 3:
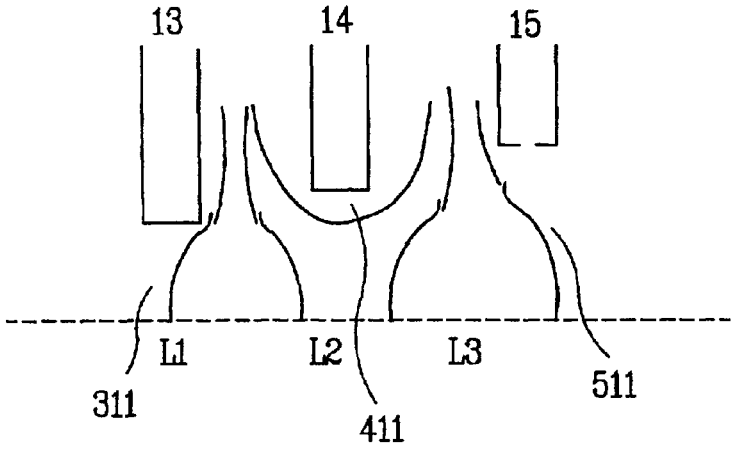
FIG. 3 is a conceptional view illustrating the potential distribution of an electron gun for a cathode ray tube according to the present invention.
Figure 4:
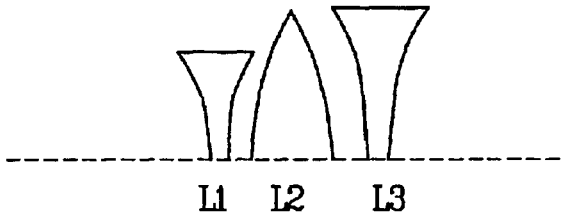
FIG. 4 illustrates an optical model of an electron lens of an electron gun for a cathode ray tube according to the present invention.

Referring to FIGS. 3 and 4, a lens L1 denotes an emitting lens by the third and fourth electrodes, a lens L2 denotes a focus lens by the third, fourth, and fifth electrodes, and a lens L3 denotes an emitting lens by the fourth and fifth electrodes.

In FIG. 3, the electron beam through hole 411 of the fourth electrode 14 is greater than the electron beam through hole 311 of the third electrode 13. The electron beam through hole 511 of the fifth electrode 15 is greater than the electron beam through hole 411 of the fourth electrode 14. In this case, the intensity of the lens L2 becomes more robust than that of the related art electron gun (the electron beam through hole 311<the electron beam through hole 411=the electron beam through hole 511). Thus, the emitting angle $\alpha$ of the electron beam to the main lens and the size Db of the electron beam in the main lens can decrease. A decrease of the emitting angle α of the electron beam and the size Db of the electron beam reduces the spherical aberration, thereby reducing the size of a spot on a screen.

If the emitting angle α of the electron beam and the size Db of the electron beam in the main lens depart from an optimal value, the size of the electron beam through hole 411 of the fourth electrode 14 is adjusted appropriately. That is, if the electron beam through hole 411 of the fourth electrode 14 becomes great, the intensity of the lens L2 is weaker than the intensity of the lenses L1 and L3. Thus, the emitting angle α of the electron beam and the size Db of the electron beam in the main lens become great. On the other hand, if the electron beam through hole 411 of the fourth electrode 14 becomes small, the intensity of the lens L2 becomes more robust than the intensity of the lenses L1 and L3. Thus, the emitting angle α of the electron beam and the size Db of the electron beam in the main lens become small.

Figure 6:
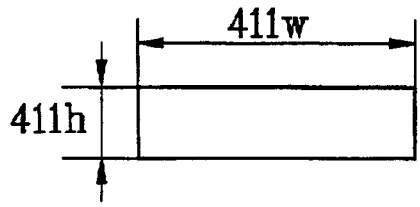
FIG. 6 is a schematic view illustrating an electron gun for a cathode ray tube according to the third embodiment of the present invention.
Figure 7:
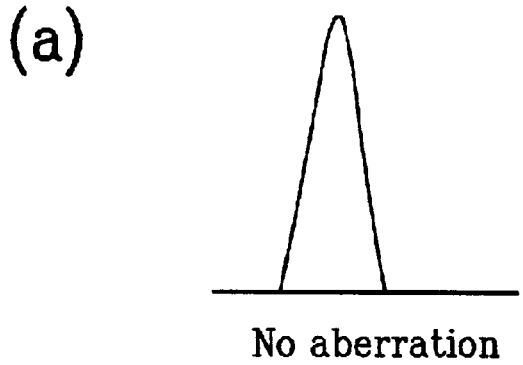
FIG. 7*a* is a graph illustrating the current density distribution on a screen in case of no spherical aberration.
FIG. 7*b* is a graph illustrating the current density distribution on a screen in case of spherical aberration.
Figure 8:
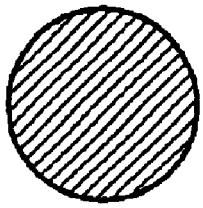
FIG. 8*a* illustrates a shape of a spot on a screen in case of no spherical aberration.
FIG. 8*b* illustrates a shape of a spot on a screen in case of spherical aberration.
Figure 8:
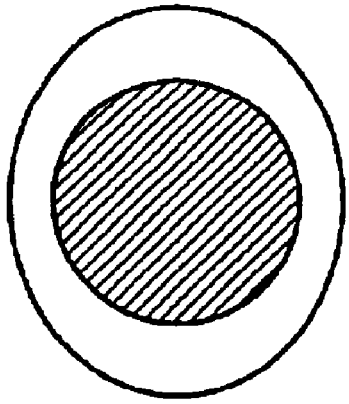

Meanwhile, the electron beam through holes 311, 411, and 511 are not limited to shapes suggested in the present invention. That is, the electron beam through holes may have a circular shape, a rectangular shape, or the like. As shown in FIG. 6, if the electron beam through hole 411 of the fourth electrode has a rectangular shape, it is preferable that its vertical length 411*h* is different from its horizontal length 411*w*. This is because the emitting angle α of the electron beam in vertical and horizontal directions and the size Db of the electron beam in the main lens can be adjusted.

Figure 5:
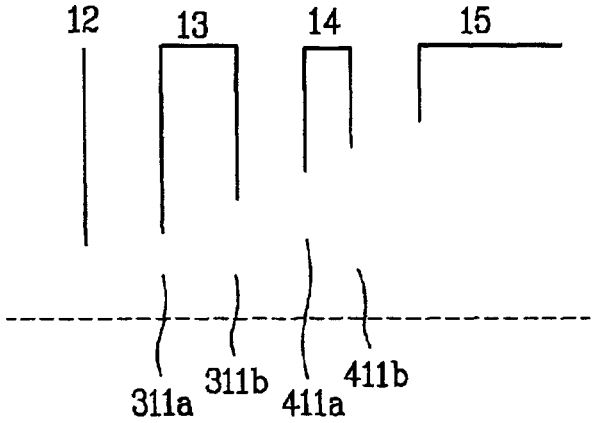
FIG. 5 is a schematic view illustrating an electron gun for a cathode ray tube according to the second embodiment of the present invention.

An electron gun for a cathode ray tube according to the second embodiment of the present invention will be described with reference to FIG. 5.

In the above embodiment, while the third and fourth electrodes 13 and 14 have plate shapes, they are not limited to plate shapes. That is, the third electrode 13 and/or the fourth electrode 14 may have a cylindrical shape. The third electrode 13 may have a first through hole 311*a* opposite to the second electrode 12 and a second through hole 311*b* opposite to the fourth electrode 14. In this case, it is preferable that the size of the first through hole 311*a* is different from the size of the second through hole 311*b*. More preferably, the size of the first through hole 311*a* is smaller than the size of the second through hole 311*b*.

The fourth electrode 14 may also have a first through hole 411*a* opposite to the third electrode 13 and a second through hole 411*b* opposite to the fifth electrode 15.

Meanwhile, it is preferable to satisfy the relation of {the size of the electron beam through hole 511 of the fifth electrode×0.1}≦the size of the electron beam through hole 311 of the third electrode 13≦{the size of the electron beam through hole 511 of the fifth electrode×0.5}. This is because the assembly of the electron gun is not easy if the size of the electron beam through hole 311 of the third electrode is smaller than {the size of the electron beam through hole 511 of the fifth electrode×0.1} while aberration of a tripod increases to increase the size of the spot on the screen if the size of the electron beam through hole 311 of the third electrode is greater than {the size of the electron beam through hole 511 of the fifth electrode×0.5}.

Furthermore, it is preferable to satisfy the relation of {the size of the electron beam through hole 511 of the fifth electrode×0.5}≦the size of the electron beam through hole 411 of the fourth electrode 14≦{the size of the electron beam through hole 511 of the fifth electrode}. This is because that the emitting angle decreases considerably to depart from an optimal emitting angle, thereby increasing the size of the spot on the screen if the size of the electron beam through hole 411 of the fourth electrode is smaller than {the size of the electron beam through hole 511 of the fifth electrode×0.5} while assembly of the electron gun is not easy if the size of the electron beam through hole 411 of the fourth electrode is greater than {the size of the electron beam through hole 511 of the fifth electrode}.

As aforementioned, the electron gun for a cathode ray tube according to the present invention has the following advantages.

It is easy to design the emitting angle of the electron beam to the main lens and the size of the electron beam in the main lens. That is, the emitting angle and the size of the electron beam can be reduced by adjusting the respective size of the electron beam through holes of the third to fifth electrodes. This can reduce the spherical aberration and can prevent the spot on the screen from being degraded.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An electron gun for a cathode ray tube comprising a cathode that emits electron beams, a first electrode that controls the electron beams emitted from the cathode, a second electrode that accelerates the electron beams emitted from the first electrode, and third to fifth electrodes sequentially arranged in a screen direction to act as pre-focus lenses, wherein the third to fifth electrodes have electron beam through holes, all of which are different in size from one another, and wherein each electron beam through hole of the third and fourth electrodes is smaller than the electron beam through hole of the fifth electrode, and the electron beam through hole of the third electrode is smaller than that of the fourth electrode, and the size of the electron beam through hole of the third electrode is greater than the size of the electron beam through hole of the fifth electrode×0.1 and less than the size of the electron beam through hole of the fifth electrode×0.5.

2. The electron gun for a cathode ray tube as claimed in claim 1, wherein the electron beam through hole of the fourth electrode has a rectangular shape and its vertical length is different from its horizontal length.

3. The electron gun for a cathode ray tube as claimed in claim 1, wherein the third electrode has a first through hole opposite to the second electrode and a second through hole opposite to the fourth electrode.

4. The electron gun for a cathode ray tube as claimed in claim 3, wherein the size of the first through hole is different from that of the second through hole.

5. The electron gun for a cathode ray tube as claimed in claim 4, wherein the size of the first through hole is smaller than that of the second through hole.

6. The electron gun for a cathode ray tube as claimed in claim 1, wherein the size of the electron beam through hole of the fourth electrode is greater than the size of the electron beam through hole of the fifth electrode×0.5 and less than the size of the electron beam through hole of the fifth electrode.

7. The electron gun for a cathode ray tube as claimed in claim 1, wherein an electron beam spot does not degrade.

8. The electron gun for a cathode ray tube as claimed in claim 1, wherein the third electrode has a first through hole opposite to the second electrode and a second through hole opposite to the fourth electrode, and the fourth electrode has a first through hole opposite to the third electrode and a second through hole opposite to the fifth electrode.

9. An electrode gun for a cathode ray tube comprising a cathode that emits electron beams, a first electrode that controls the electron beams emitted from the cathode, a second electrode that accelerates the electron beams emitted from the first electrode, wherein third to fifth electrodes sequentially arranged in a screen direction to act as pre-focus lenses, and the third to fifth electrodes have electron beam through holes, all of which are different in size from one another, and the size of the electron beam through hole of the third electrode is greater than the size of the electron beam through hole of the fifth electrode×0.1 and less than the size of the electron beam through hole of the fifth electrode×0.5, and wherein no separate supplemental electrode is provided.

10. An electron gun for a cathode ray tube comprising:

a cathode emitting electron beams;

a first electrode controlling the electron beams emitted from the cathode;

a second electrode accelerating the electron beams emitted from the first electrode; and third to fifth electrodes sequentially arranged in a screen direction to act as pre-focus lenses, the third to fifth electrodes having electron beam through holes, all of which are different in size from one another, and the size of the electron beam through hole of the third electrode is greater than the size of the electron beam through hole of the fifth electrode×0.1 and less than the size of the electron beam through hole of the fifth electrode×0.5.

11. The electron gun as claimed in claim 10, wherein each electron beam through hole of the third and fourth electrodes is smaller than the electron beam through hole of the fifth electrode.

12. The electron gun as claimed in claim 11, wherein the electron beam through hole of the third electrode is smaller than that of the fourth electrode.

13. The electron gun as claimed in claim 10, wherein the size of the electron beam through hole of the fourth electrode is greater than the size of the electron beam through hole of the fifth electrode×0.5 and less than the size of the electron beam through hole of the fifth electrode.

14. The electron gun as claimed in claim 10, wherein the beam through hole of the fourth electrode is smaller than the electron beam through hole of the fifth electrode adjacent to the beam through hole of the fourth electrode.

15. The electron gun as claimed in claim 14, wherein the electron beam through hole of the third electrode is smaller than the beam through hole of the fourth electrode adjacent to the beam through hole of the third electrode.

16. An electron gun for a cathode ray tube comprising:

a cathode emitting electron beams;

a first electrode controlling the electron beams emitted from the cathode;

a second electrode accelerating the electron beams emitted from the first electrode; and third to fifth electrodes sequentially arranged in a screen direction to act as pre-focus lenses and each having at least one electron beam through hole, wherein the electron beam through hole of the fourth electrode and the electron beam through holes each included in the third and fifth electrode and adjacent to the electron beam through hole of the fourth electrode are different in size from one another, and the size of the electron beam through hole of the third electrode is greater than the size of the electron beam through hole of the fifth electrode×0.1 and less than the size of the electron beam through hole of the fifth electrode×0.5.

* * * * *

UNITED STATES PATENT AND TRADEMARK OFFICE

CERTIFICATE OF CORRECTION

PATENT NO. : 7,045,943 B2
APPLICATION NO. : 10/162874
DATED : May 16, 2006
INVENTOR(S) : Dae Sik Hwang It is certified that error appears in the above-identified patent and that said Letters Patent is hereby corrected as shown below:

On Title Page of Patent, item 73, please correct the address of the Assignee from "Kimi-Shi" to --Kumi-Shi--.

Signed and Sealed this

Twenty-sixth Day of February, 2008

JON W. DUDAS
*Director of the United States Patent and Trademark Office*